US008970119B2

(12) United States Patent
Fujita

(10) Patent No.: US 8,970,119 B2
(45) Date of Patent: Mar. 3, 2015

(54) LIGHT EMITTING DEVICE AND METHOD OF CONTROLLING LIGHT EMITTING DEVICE

(75) Inventor: Tsukasa Fujita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 85 days.

(21) Appl. No.: 13/811,795

(22) PCT Filed: Jun. 15, 2011

(86) PCT No.: PCT/JP2011/063655
§ 371 (c)(1),
(2), (4) Date: Jan. 23, 2013

(87) PCT Pub. No.: WO2012/011339
PCT Pub. Date: Jan. 26, 2012

(65) Prior Publication Data

US 2013/0119873 A1 May 16, 2013

(30) Foreign Application Priority Data

Jul. 23, 2010 (JP) ..... 2010-166261

(51) Int. Cl.
*H05B 37/02* (2006.01)
*G09G 3/34* (2006.01)
*H05B 33/08* (2006.01)

(52) U.S. Cl.
CPC ..... *H05B 37/02* (2013.01); *G09G 3/3406* (2013.01); *H05B 33/0887* (2013.01); *G09G 2320/041* (2013.01); *G09G 2330/04* (2013.01); *G09G 2330/02* (2013.01)
USPC ..... 315/194; 315/291; 315/312

(58) Field of Classification Search
USPC ..... 315/291, 299, 294, 194, 312
See application file for complete search history.

(56) References Cited

U.S. PATENT DOCUMENTS 8,334,662 B2 * 12/2012 Jin et al. ..... 315/299
2004/0195978 A1 * 10/2004 Horiuchi et al. ..... 315/291

FOREIGN PATENT DOCUMENTS

JP 2003-332623 A 11/2003
JP 2003-332633 A 11/2003
JP 2007-242477 A 9/2007

* cited by examiner

*Primary Examiner* — Douglas W Owens
*Assistant Examiner* — Syed M Kaiser
(74) *Attorney, Agent, or Firm* — Lowe Hauptman & Ham, LLP

(57) ABSTRACT

An LED backlight includes a light emitting unit, a driver, a current divider, and a power supply unit. The lighting unit includes a plurality of LEDs connected in series. The driver is connected in series with the LEDs and configured to control driving of the light emitting unit. The current divider is connected in parallel to the driver of a series circuit including the light emitting unit and the driver. The power supply unit is configured to apply a voltage to the series circuit.

12 Claims, 7 Drawing Sheets

LIGHT EMITTING DEVICE AND METHOD OF CONTROLLING LIGHT EMITTING DEVICE

RELATED APPLICATIONS

The present application is a National Phase of International Application Number PCT/JP2011/063655, filed Jun. 15, 2011, and claims priority from Japanese Application Number 2010-166261.

TECHNICAL FIELD

The present invention relates to a light emitting device including light emitting components such as LEDs and a method of controlling the light emitting device.

BACKGROUND ART

The increased number of light emitting devices including LEDs (light emitting diodes) or other types of semiconductor components as light emitting components is used in recent years. Researches have been conducted on such light emitting devices for application thereof to light sources of backlight for liquid crystal displays because of high initial-driving performances and tolerances to vibration and repeated switching between on and off.

An example of light emitting device circuit configuration is disclosed in Patent Document 1. In light emitting devices having similar configurations as the one in Patent Document 1, power losses may increase depending on circuit configurations of the light emitting devices. This is because different control is required for those devices from devices including CCFLs (cold cathode fluorescent lamp) as light sources, which are conventional light sources of backlights. When the power losses increase, the amounts of heat generated during power consumption increase resulting in temperatures increases in the light emitting device. Therefore, some kind of measures to reduce the temperatures of the light emitting device, such as a heatsink, is required.

A technology for reducing a power loss in the light emitting device is disclosed in Patent Document 1. According to the technology, the power loss is reduced by the following method. In a circuit for driving sets of light emitting components in which light emitting components are connected in series, forward voltages in the sets are measured and a common voltage applied to the sets is properly adjusted.

RELATED ART DOCUMENT

Patent Document

Patent Document 1: Japanese Unexamined Patent Application Publication No. 2007-242477

Problem to be Solved by the Invention

Even if the technology disclosed in Patent Document 1 is used, a power loss due to differences in forward voltage among the sets of light emitting components cannot be reduced. The forward voltages of the sets are different from each other due to differences in forward voltage of each light emitting components. Therefore, the common voltage is determined based on the maximum forward voltage and applied to the sets of light emitting components. If the forward voltage of the set is not the maximum forward voltage, an excessive voltage is applied to a driver connected in series with the set of the light emitting components. Current that flow through respective sets of light emitting components are controlled by drivers to remain constant at a common amount. Certain amounts of currents flow through the drivers connected in series with the sets of light emitting components. Namely, a power loss due to the excessive voltage applied to the driver for the set of light emitting components, the forward voltage of which is not the maximum voltage, cannot be reduced. As a result, the temperature increases in some areas. Therefore, some measures for reducing the temperature increase of the drivers, such as heatsinks, are required.

DISCLOSURE OF THE PRESENT INVENTION

The present invention was made in view of the foregoing circumstances. An object of the present invention is to reduce a temperature increase in a driver due to differences in forward voltage of sets of light emitting components.

Means for Solving the Problem

To solve the above problem, a light emitting device according to the present invention includes a light emitting unit, a driver, a current divider, and a power supply unit. The light emitting unit includes a plurality of light emitting components connected in series. The driver is configured to control driving of the light emitting unit and connected in series with the light emitting components so as to form a series circuit. The current divider is connected in parallel to the driver of the series circuit. The power supply unit is configured to apply a voltage to the series circuit.

In this light emitting device, the current divider is connected in parallel to the driver of the series circuit. Therefore, some of the current from the light emitting unit can be fed to the current divider and an amount of current in the driver can be reduced in comparison to an amount of current flowing through the light emitting unit. According to the light emitting device, the amount of current in the driver can be reduced even when an excessive voltage is applied to the driver. Therefore, a power loss in the driver can be reduced and a temperature increase in the driver can be reduced.

In the light emitting device according to the present invention, the series circuit may include a plurality of series circuits connected in parallel to each other and to the current divider. The power supply unit may be configured to apply the same voltage to the series circuits. The control of the driving of the light emitting unit may be performed such that currents that flow through the light emitting units are adjusted to a common constant amount. If a first forward voltage Vf1 of a first light emitting unit of a first series circuit is lower than a second forward voltage Vf2 of a second light emitting unit of the second series circuit, a first divided current Id1 in a first current divider connected to the first series circuit may be adjusted larger than a second divided current Id2 in a second current divider connected to the second series circuit.

If the series circuits are connected in parallel to each other and the same voltage is applied to the series circuit by the power supply unit, excessive voltages are more likely to be applied to the drivers due to differences in forward voltages between the light emitting units. In one of the series circuits of this light emitting device, the forward voltage of the light emitting unit is relatively low and a relatively high excessive voltage is applied to the driver. The divided currents are set such that a relatively large divided current flows in the current divider connected to the series circuit. Namely, in the series circuit including the driver to which a relatively high excessive high voltage is applied to the driver, the divided current is adjusted such that a relatively small current flows in the driver. According to the light emitting device, a power loss in the driver can be reduced and a temperature increase in the driver can be reduced.

At least one of the current dividers may be connected to a regenerator configured to store a power by receiving the divided current in corresponding one of the current dividers. A power that is lost by a driver in a known configuration can be stored by the regenerator and thus a power loss in a generator can be reduced.

Each current divider may include a current divider driver configured to perform driving control on the divided current therein. With the current divider driver, the amount of current in the current divider can be adjusted. As a result, the amount of current in the driver can be properly adjusted.

The light emitting device may further include a control unit configured to control the driver and the current divider driver. Through the control of the driver and the current divider driver by the control unit, the currents that flow through the light emitting units can be controlled and the currents in the drivers and the current dividers are controlled, respectively. According to the light emitting device, the amounts of current that flow through the light emitting units can be maintained constant and the amounts of currents in the drivers and the current dividers can be properly adjusted.

The control unit may be configured to measure a driver voltage Vk applied to the driver of each series circuit, a driver current Ik of the driver, and the divided current Id in each current driver connected to the series circuit, and to control the driver and the current divider driver based on the measurements. With this configuration, the amounts of currents that flow through the light emitting units, the drivers, and the current dividers can be properly adjusted.

The control unit may be configured to control the current divider driver to restrict a flow of the divided current in the current divider connected to the series circuit including the light emitting unit, the forward voltage of which is the maximum voltage among the series circuit.

In the series circuit including the light emitting unit, the forward voltage of which is the maximum voltage, the voltage applied by the power supply unit is determined based on the series circuit. Generally, an excessive voltage is not produced in the driver or the excessive voltage is reduced. In such a driver, a power loss is small or a measure for reducing a temperature increase in the driver such as a heatsink may not be required. In this light emitting device, the control unit controls the current divider driver to restrict the flow of divided current in the current divider in the series circuit including the light emitting unit, the forward voltage of which is the maximum voltage. According to the light emitting device, the control by the control unit can be simplified.

The constant current light emitting components may be LEDs. With this configuration, a temperature increase in the driver configured to drive the LEDs in the light emitting device including the LEDs can be reduced.

The light emitting device may be configured for a liquid display device. With this configuration, the light emitting device in which a temperature increase in the driver is reduced can be used for a backlight of a liquid crystal display. Namely, a backlight in which a light emitting amount is adjusted and a local temperature increase is less likely to occur can be provided.

Advantageous Effect of the Invention

According to the present invention, a temperature increase in the driver due to forward voltage differences between the light emitting components can be reduced. Therefore, a measure for reducing the temperature increases in the driver such as a heatsink is not required or a size of the heatsink can be reduced even in a case that the heatsink is required. The configuration of the light emitting device can be simplified and the manufacturing cost can be reduced.

MODE FOR CARRYING OUT THE INVENTION

Embodiment

An embodiment of the present invention will be explained with reference to the drawings. This embodiment includes an LED backlight system 10 (an example of a light emitting device, hereinafter referred to as an LED backlight) as a backlight for a light emitting unit of a liquid crystal display device. However, a light emitting unit to which the scope of the present invention can be applied is not limited to the LED backlight 10. The scope of the present invention can be applied to light emitting units used for various kinds of lighting devices and display devices.

1. Configuration of LED Backlight

The configuration of the LED backlight 10 will be explained with reference to FIG. 1.

Figure 1:
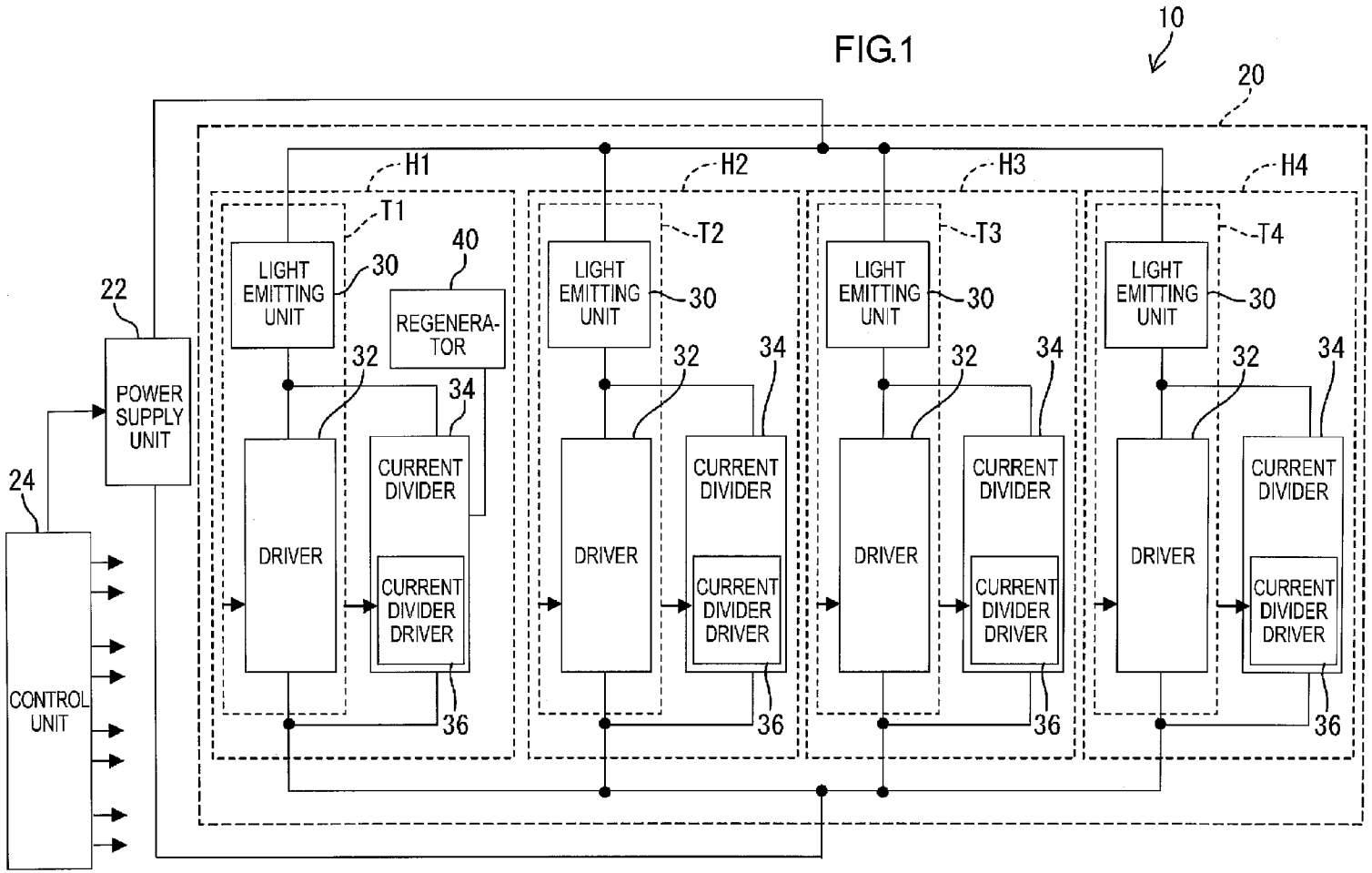
FIG. 1 is a block diagram of an LED backlight 10.

As illustrated in FIG. 1, the LED backlight 10 includes a circuit 20, a power supply unit 22, and a control unit 24. The circuit 20 includes four parallel circuits H1 to H4. The parallel circuits H1 to H4 are connected in parallel to each other. The power supply unit 22 applies a common supply voltage Vo to the parallel circuits H1 to H4.

The parallel circuit H1 includes a light emitting unit 30, a driver 32, a current divider 34, and a regenerator 40. The light emitting unit 30 and the driver 32 are connected in series to form a series circuit T1. The voltage Vo is applied to the series circuit T1. Namely, the power supply unit 22 applies the voltage Vo to the series circuit T1. The current divider 34 is connected in parallel to the driver 32 of the series circuit T1. The current divider 34 includes a current divider driver 36. The regenerator 40 is connected to the current divider 34.

The control unit 24 is connected to the power supply unit 22 and configured to control the supply voltage Vo output by the power supply unit 22. The control unit 24 is connected to the drivers 32 and the current dividers 34 of the parallel circuits H1 to H4 via separate lines and configured to individually control the drivers 32 and the current dividers 34.

The parallel circuits H2 to H4 have the same configuration as that of the parallel circuit H1 except for the regenerator 40 and thus the configuration thereof will not be explained.

Figure 2:
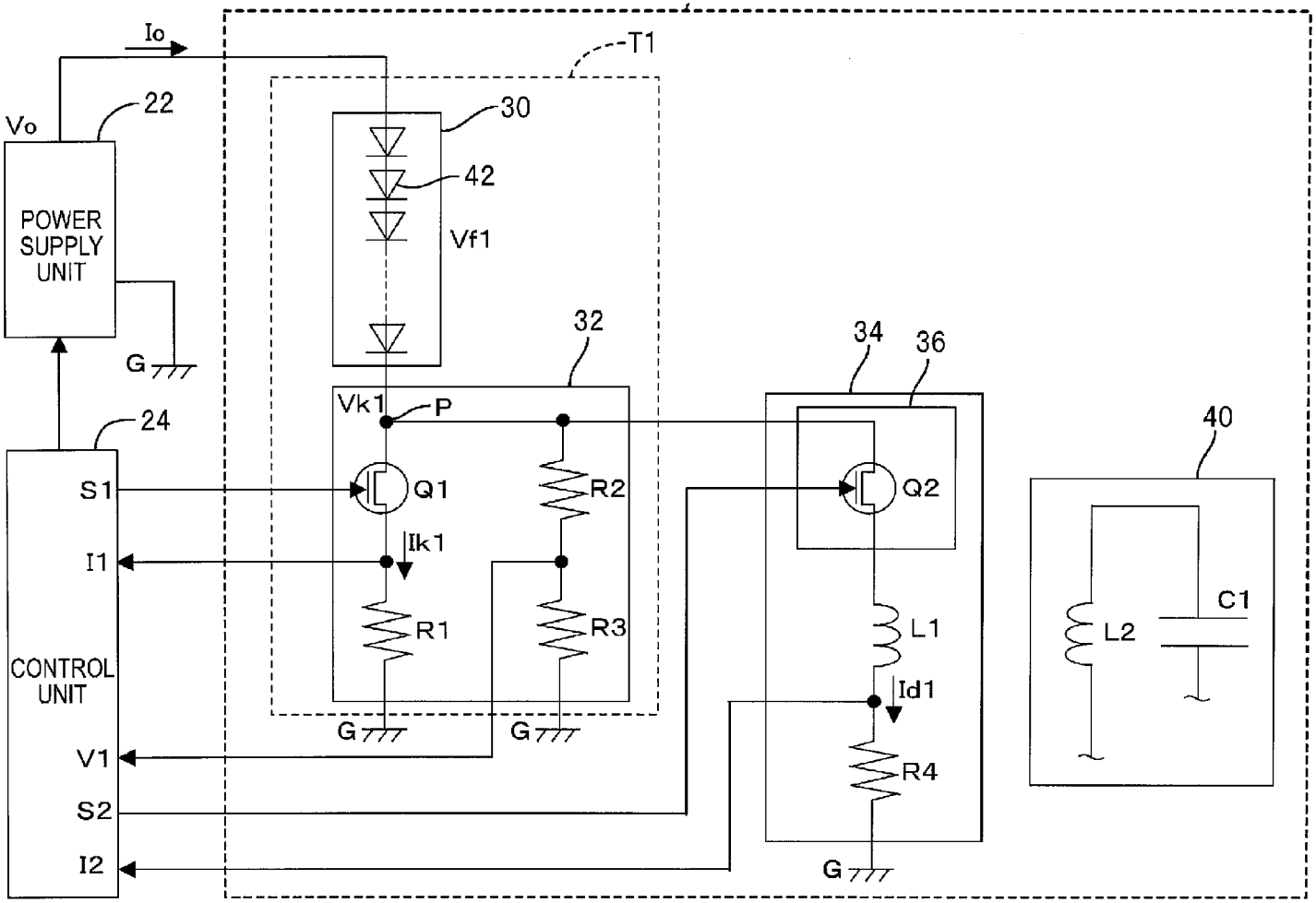
FIG. 2 is a circuit diagram of a parallel circuit H1.

FIG. 2 illustrates a detailed circuit configuration of the parallel circuit H1.

Light Emitting Unit 30

The light emitting unit 30 includes a plurality of white LEDs 42 (an example of a light emitting component) connected in series. Generally, each LED 40 is designed such that light emitting efficiency is at the maximum under constant current control. Therefore, the current that flows through the light emitting unit 30 is regulated to a predetermined constant current Io. In the LED 40, a forward voltage drop occurs due to the current flowing through the LED 40, and a forward voltage Vf1 appears at the light emitting unit 30. A driver voltage Vk1 is calculated by subtracting the forward voltage Vf1 of the light emitting unit 30 from the supply voltage Vo applied by the power supply unit 22 (Vo−Vf1). The driver voltage Vk1 is applied to the driver 32 and the current divider 36 connected in parallel to the driver 32.

Generally, the forward voltage drops that occur in the LEDs 42 are different from one another. Therefore, the forward voltages Vf1 appear at the light emitting units 30 are different from one another. Namely, different driver voltages Vk1 to Vk4 are applied to the respective drivers 32.

Driver 32

Each driver 32 includes a switching component Q1 (e.g., FET or another type of switching component having a similar configuration) and resistors R1 to R3. The switching component Q1 and the resistor R1 are connected in series between a connecting point P and the ground G. The resistors R2 and R3 are connected in series between the connecting point P and the ground G. The connecting point P is a point at which the driver 32 is connected to the light emitting unit 30. The ground G is also a point at which the driver 32 is connected to the power supply unit 22. The resistances of the resistors R2 and R3 are set higher than those of the switching component Q1 and the resistor R1. Therefore, the flow of current through the resistors R2 and R3 in the driver 32 is restricted.

The switching component Q1 is connected to a control terminal S1 of the control unit 24 and controlled by the control unit 24 between open and closed. As described earlier, the current flow through the resistors R2 and R3 is restricted in the driver 32, and a current flows through the switching component Q1 and the resistor R1. When the control unit 24 opens the switching component Q1, the driver current Ik1 flows. When the control unit 24 closes the switching component Q1, the driver current Ik1 stops. Namely, the flow of the driver current Ik1 in the driver 32 is controlled by the control unit 24 using the switching component Q1.

A current measurement terminal I1 of the control unit 24 is connected to the midpoint between the switching component Q1 and the resistor R1 for measuring the driver current Ik1 that flows through the driver 32. A voltage measurement terminal V1 is connected to the midpoint between the resistors R2 and R3 for measuring the driver voltage Vk1 applied to the point P based on a resistance ratio between the resisters R2 and R3.

Current Divider 34

Each current divider 34 includes a switching component Q2, a coil L1, and a resistor R4 that are connected in series in this sequence between the point P and the ground G. The switching component Q2 is connected to a control terminal S2 of the control unit 24 and is controlled by the control unit 24 between open and closed. When the control unit 24 opens the switching component Q2, a divided current Id1 flows in the current divider 34. When the control unit 24 closes the switching component Q2, the divided current Id1 stops. Namely, the switching component Q2 functions together with the control unit 24 as a current divider driver 36 for controlling the divided current Id1 that flows in the current divider 34. A current measurement terminal I2 of the control unit 24 is connected to the midpoint between the coil L1 and the resistor R4 for measuring the divided current Id1 that flows in the current divider 36.

Regenerator 40

The regenerator 40 includes at least a coil L2 and a capacitor C1 connected to each other. The coil L2 is held close to the coil L1 of the current divider 34. When a current flows through the coil L1, the coils L1 and L2 are electrically or magnetically connected, and a current flows through the coil L2. As a result, energy is stored in the capacitor C1.

Control Unit 24

The control unit 24 controls the parallel circuit H1 as follows. The control unit 24 adjusts the driver current Ik1 in the driver 32 by controlling the switching component Q1 and the divided current Id1 in the current divider 34 by controlling the switching component Q2. As a result, the current (Ik1+Id1) that flows through the light emitting unit 30 is controlled. As described earlier, the current that flow through the light emitting unit 30 needs to be controlled at the predetermined constant current Io. During the control of the driver current Ik1 and the divided current Id1, the control unit 24 determines the amounts of the driver current Ik1 and the divided current Id1. The control unit 24 determines the amounts by adjusting the ratio of the driver current Ik1 to the divided current Id1 while maintaining the total amount of the currents Ik1 and Id1 at the predetermined constant current Io.

The control unit 24 measures the driver current Ik1 and the divided current Id1 at current measurement terminals I1 and I2. The control unit 24 reflects the measurements on the control of the switching components Q1 and Q2. Therefore, the driver current Ik1 and the divided current Id1 are controlled with high accuracies. The control unit 24 measures the driver voltage Vk1 at a voltage measurement terminal V1. The control unit 24 reflects the measurement on the control of the supply voltage Vo from the power supply unit 22. Therefore, the supply voltage Vo is controlled with a high accuracy according to environmental factors including temperature.

Control by Control Unit

Figure 3:
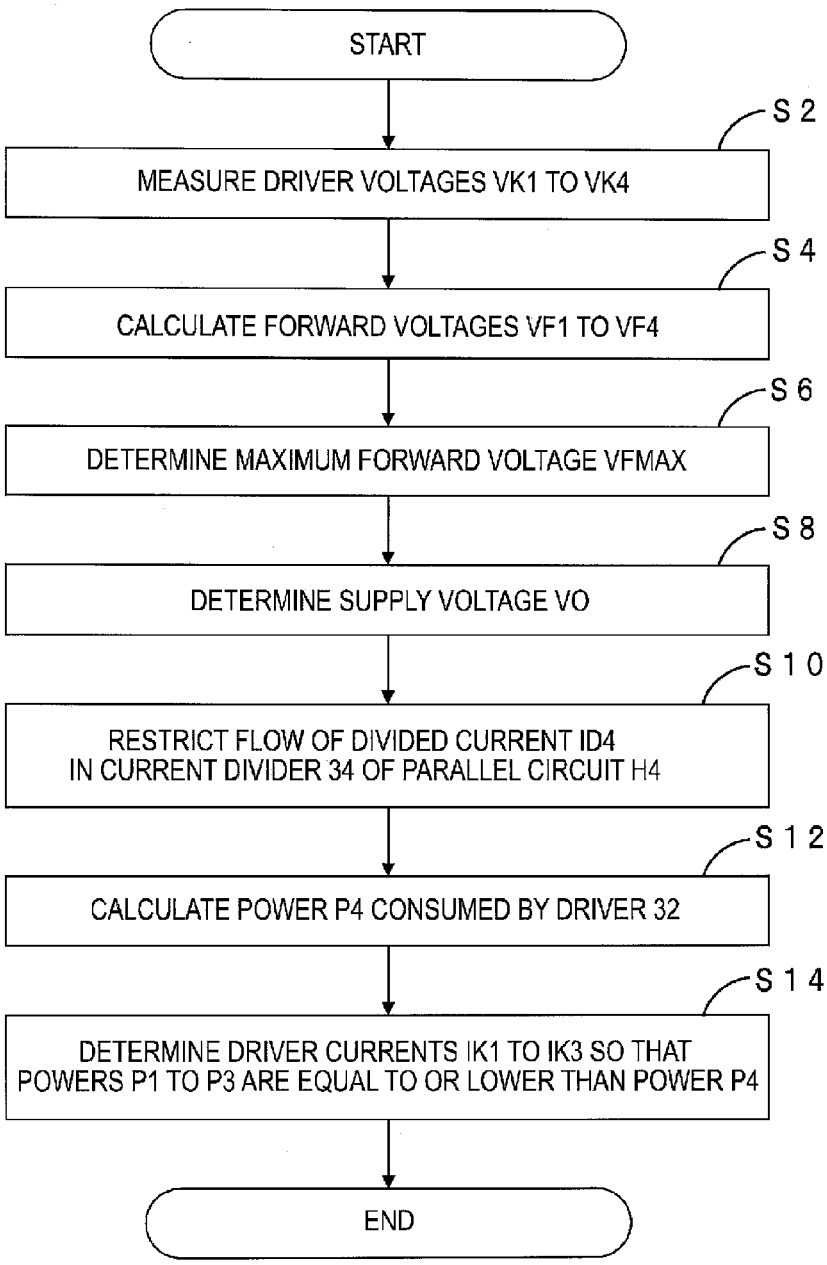
FIG. 3 is a flowchart illustrating a control process performed by a control unit 24.

The control performed by the control unit 24 will be explained with reference to FIG. 3.

The control unit 24 is connected to the parallel circuits H1 to H4. The control unit 24 measures the driver voltages Vk1 to Vk4, the driver currents Ik1 to Ik4, and the divided currents Id1 to Id4 of the parallel circuits. The control unit 24 controls the drivers 32 and the current divider driver 36 of the parallel circuits and the power supply unit 22 with reference to the measurements. The driver currents Ik1 to Ik4 and the divided current Id1 to Id4 are adjusted to satisfy the following condition.

$$Ikn+Idn=Io, \text{ where } n=1 \text{ to } 4$$

The control unit 24 measures the forward voltages Vk1 to Vk4 of the parallel circuits (step S2), and calculates the forward voltages Vf1 to Vf4 of the parallel circuits (step S4). The forward voltages Vf1 to Vf4 are determined based on the currents Io that flow through the light emitting units 30. The forward voltages Vf1 to Vf4 do not depend on the supply voltage Vo. The forward voltages Vf1 to Vf4 are calculated as follows.

$$Vfn=Vo-Vkn, \text{ where } n=1 \text{ to } 4$$

The control unit 24 compares the calculated forward voltages Vf1 to Vf4 with each other, and determines the maximum forward voltage Vfmax (step S6). In this embodiment, the forward voltages Vf1 to Vf4 have relationships of Vf1<Vf2<Vf3<Vf4 and thus the control unit 24 selects Vf4 as the maximum forward voltage Vfmax.

The control unit 24 determines the supply voltage Vo from the power supply unit 22 based on the maximum forward voltage Vfmax (step S8). The drivers 32 and the current dividers 34 include components such as the switching components Q and the resistors R, respectively. Therefore, the minimum driver voltage Vkmin is required for each driver 32 for normal operation of these components. The control unit 24 calculates the supply voltage Vo from the maximum forward voltage Vfmax and the minimum driver voltage Vkmin. Therefore, voltages applied to the light emitting unit 30, the drivers 32, and the current dividers 34 are less likely to become insufficient. Furthermore, excessive voltages are less likely to be applied to the drivers 32 and the current dividers 34. The following is an equation for calculating the supply voltage Vo.

$$Vo=Vf\max+Vk\min$$

The control unit 24 controls the current divider 36 of the parallel circuit H4, the forward voltage Vf4 of which is the maximum forward voltage Vfmax, to restrict the flow of the divided current Id4 in the current divider 34 of the parallel circuit H4 (step S10). The control unit 24 calculates a power P4 consumed by the driver 32 of the parallel circuit H4 (step S12). Namely, the driver current Ik4, the divided current Id4, and the power P4 are expressed as follows.

$$Ik4=Io,\ Id4=0,\ P4=Vk4\times Ik4=(Vo-Vf4)\times Io$$

The control unit 24 determines the driver currents Ik1 to Ik3 so that the powers P1 to P3 of the drivers 32 of the parallel circuits H1 to H3 are equal to or lower than the power P4 of the driver 32 of the parallel circuit H4 (step S14). The powers P1 to P3 of the drivers 32 of the parallel circuits H1 to H3 are expressed as follows.

$$Pn=Vkn\times Ikn=(Vo-Vfn)\times Ikn,\ \text{where } n=1 \text{ to } 3$$

As described earlier, the forward voltages Vf1 to Vf4 have the relationships of Vf1<Vf2<Vf3<Vf4. Therefore, the control unit 24 is required to adjust the driver currents Ik1 to Ik3 to have relationships of Ik1<Ik2<Ik3<Io. Furthermore, the control unit 24 adjusts the divided currents Id1 to Id3 to have relationships of Id1>Id2>Id3>0. Namely, the control unit 24 controls the parallel circuits H1 to H4 in which the forward voltages Vf of the light emitting units 30 are relatively small so that relatively large amount of the divided currents Id flow in the current dividers 34.

3. Waveforms of Driver and Current Divider

Figure 4:
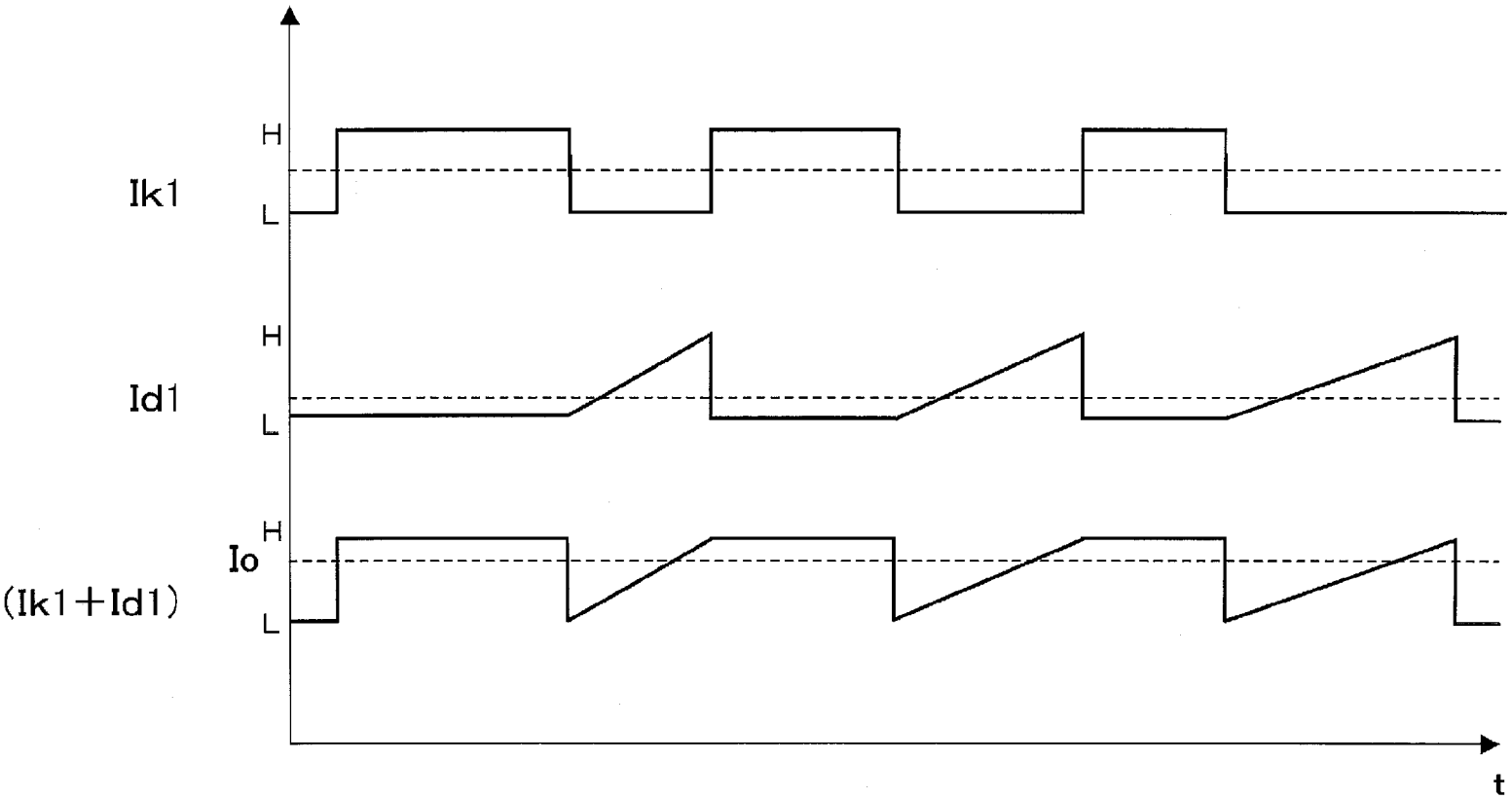
FIG. 4 is a waveform diagram illustrating waveforms of a driver current Ik and a divided current Id.

Waveforms of the driver current Ik1, the divided current Id1, and the current that flows through the light emitting unit 30 (Ik1+Id1) in the parallel circuit H1 are illustrated in FIG. 4. The letter "H" indicates a high state in which the current is large and the letter "L" indicates a low state in which the current is small. Root mean square (RMS) control is performed on the currents that flow in the light emitting units 30, the drivers 32, and the current dividers 34 in the parallel circuits H1 to H4. As illustrate in FIG. 4, the switching component Q1 is controlled such that a RMS value of the driver current Ik1 that flows in the driver 32 per reference time remains constant (as indicated by a broken line in FIG. 4). Furthermore, the switching component Q2 is controlled such that a RMS of the divided current that flows in the current divider 34 per reference time remains constant (as indicated by a broken line in FIG. 4). With the control, a RMS value of the current that flows in the light emitting unit 30 per reference time is adjusted to the constant value Io.

In this embodiment, as illustrated in FIG. 4, the divided current Id1 is stopped for feeding the driver current Ik1, and the divided current Id1 is fed for stopping the driver current Ik1. A period in which the power is consumed by the driver 32 can be separated from a period in which the power is regenerated by the regenerator 40. The power is regenerated by the regenerator 40 in a non-display period of a liquid crystal device that includes the LED backlight 10 by synchronizing the on/off timing of the driver 32 with the on/off timing of the liquid crystal display.

4. Features of this Embodiment (1) In the LED backlight 10 of this embodiment, the current dividers 34 are connected in parallel to the drivers 32 of the series circuit T1 to T4, respectively, in the parallel circuits H1 to H4. Therefore, some of the current that flows through each light emitting unit 30 can be fed to the corresponding current divider 34. The driver current Ik that flows in the driver 32 can be adjusted to a lower amount than the current Io that flows through the light emitting unit 30. According to the LED backlight 10 of this embodiment, even if excessive voltages higher than the minimum driver voltage Vimin are applied to the drivers 32, the driver currents Ik that flow in the drivers 32 are adjusted to small amounts. With this configuration, losses of the power P are reduced and the temperature increases can be reduced in the driver 32. Therefore, heatsinks for reducing the temperature increases in the drivers 32 are not required or a size of the heatsinks can be reduced even in a case that the heatsinks are required. The configuration of the LED backlight 10 can be simplified and the manufacturing cost can be reduced.

(2) In the parallel circuit H1 to H4 of the LED backlight 10 of this embodiment, the forward voltages Vf of the light emitting units 30 are set relatively low in the parallel circuits H1 to H4. Furthermore, the parallel circuits H1 to H4 are configured such that the relatively large divided current Id flows in the current divider 34 connected to the series circuit T in which the relatively high driver voltages Vk are applied to the drivers 32. Namely, the driver currents Ik that flow in the drivers 32 are set relatively small in the series circuits T in which the relatively high driver voltages Vk are applied to the drivers 32. According to the LED backlight 10 of the present invention, the losses of power P by the drivers 32 can be reduced and the temperature increases in the drivers 32 can be reduced.

(3) The LED backlight 10 of this embodiment includes the regenerator 40 in the parallel circuit H1. The power P that may be consumed by the drivers 32 according to known technologies is stored by the regenerator 40 and thus the losses of power P in the LED backlight can be reduced.

(4) In the LED backlight 10 of the present invention, the control unit 24 controls the current divider driver 36 to restrict the flows of the divided current Id in the current divider 34 in the parallel circuit H4 in which the forward voltage Vf of the light emitting units 30 is the maximum. In the parallel circuit H4, the minimum driver voltage Vkmin is applied to the driver 32. The loss of power P4 is not large in the driver 32 and the temperature increase in the driver 32 is small. Therefore, a heatsink or any other measure is not required. In the LED backlight 10 of the present invention, the current divider driver 36 of the parallel circuit H4 is control as described above, and an open or closed status thereof is not altered according to time. Therefore, the control by the control unit 24 can be simplified.

Other Embodiments

The present invention is not limited to the embodiment illustrated in the above description and the drawings. For example, the following embodiments may be included in the technical scope of the present invention.

Figure 5:
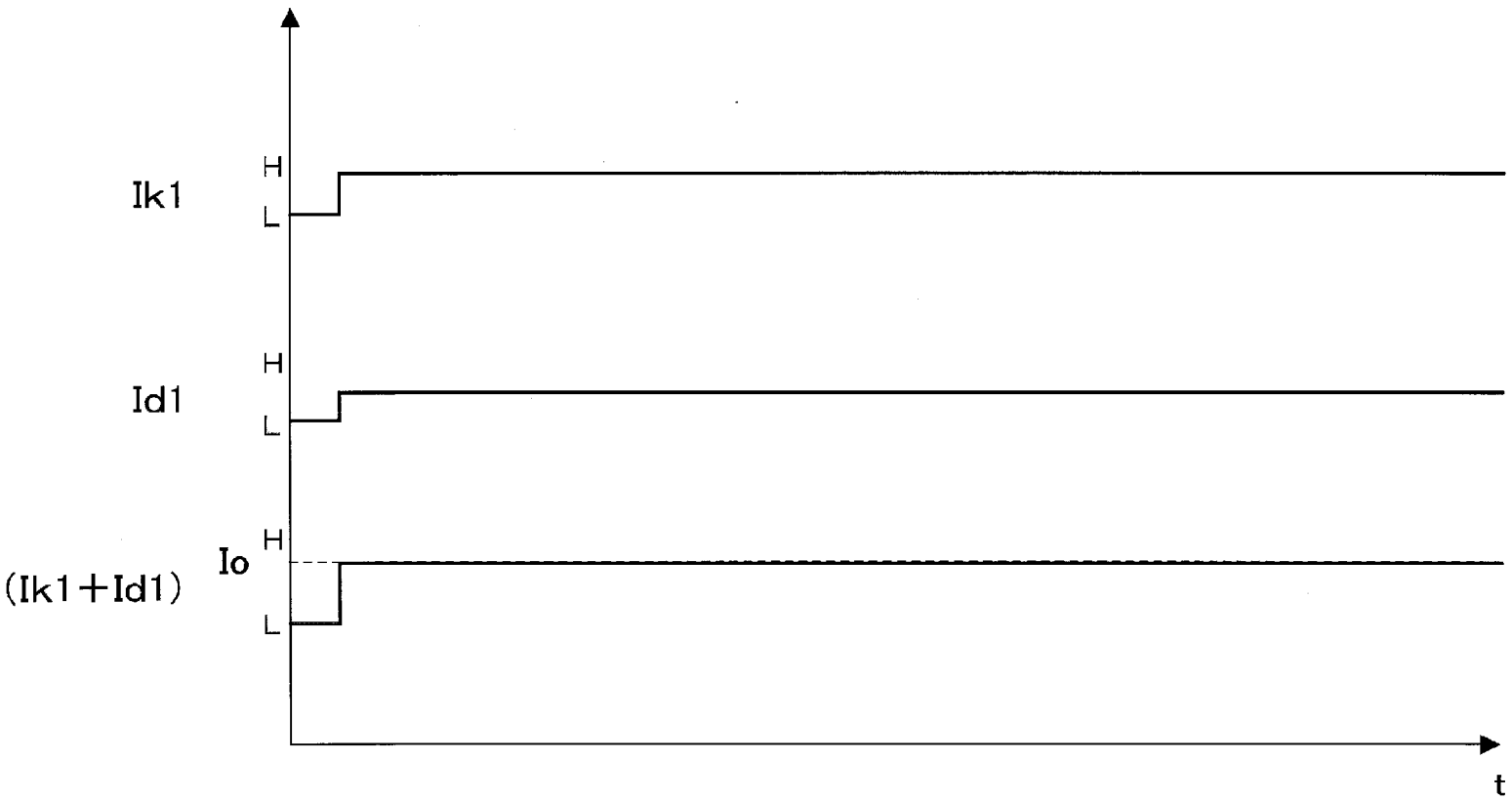
FIG. 5 is a waveform diagram illustrating waveforms of a driver current Ik and a divided current Id.
Figure 6:
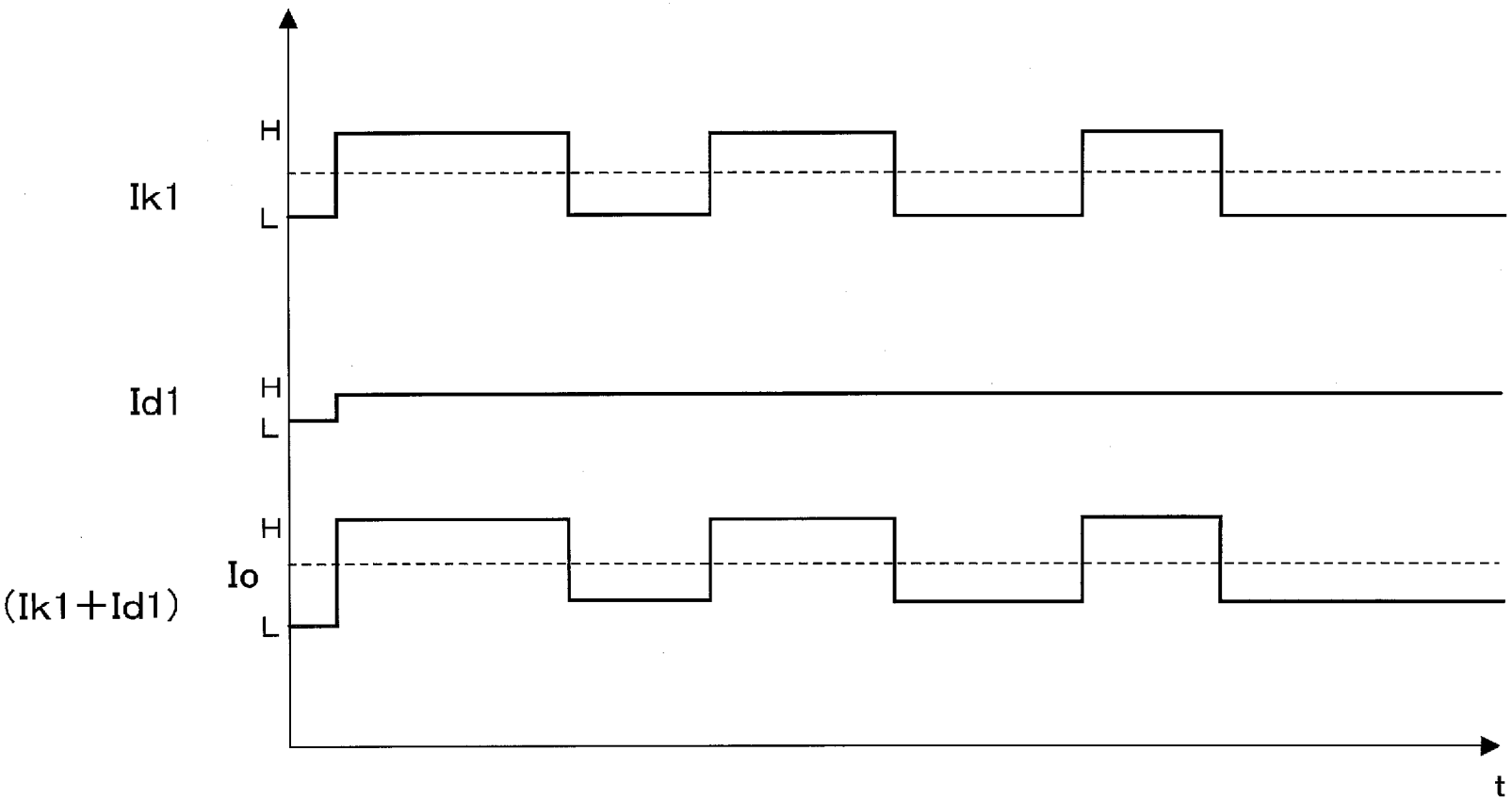
FIG. 6 is a waveform diagram illustrating waveforms of a driver current Ik and a divided current Id.

(1) In the above embodiment, the driver current Ik1 and the divided current Id1 are adjusted according to time. However, the scope of the present invention is not limited to such a configuration. As illustrated in FIG. 5, the driver current Ik1 and the divided current Id1 may be maintained constant. As illustrated in FIG. 6, one of the driver current Ik1 and the divided current Id1 may be adjusted according to time and the other one of them may be maintained constant.

Figure 7:
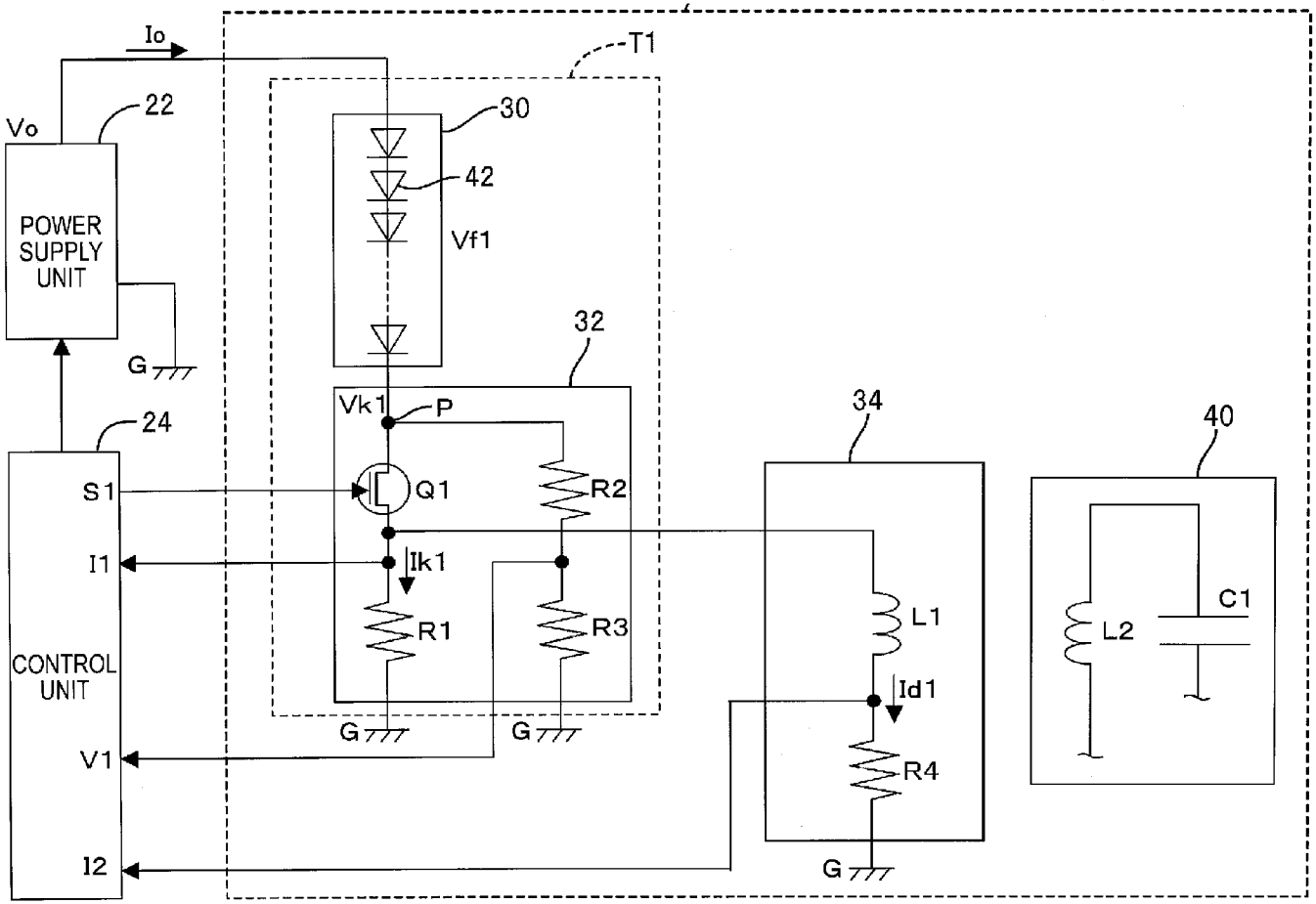
FIG. 7 is a circuit diagram of a parallel circuit H1.

(2) In the above embodiment, the current dividers 34 and the current divider drivers 36 are provided and controlled by the control unit 24. However, the scope of the present invention is not limited to such a configuration. As illustrated in FIG. 7, each current divider 34 may include a coil L1 and a resistor R4, and the current divider 34 may be connected to a part of the current divider 34, that is, the ground and the midpoint between the switching component Q1 and the resistor R1. With this configuration, a current that flows through the light emitting unit 30 can be adjusted by the driver 32. Furthermore, the resistors R1 and R4 and the coil L1 may be configured based on the forward voltages Vf1 to Vf4 of the light emitting units 30 of the parallel circuits H1 to H4. By do so, a ratio of each driver current Ik to the corresponding divided current Id can be adjusted and thus the control by the control unit 24 can be simplified.

(3) In the above embodiment, the regenerator 40 includes the capacitor C1. However, the scope of the present invention is not limited to such a configuration. For example, the regenerator 40 may include a storage cell or any other type of component configured to store energy.

(4) In the above embodiment, the LEDs 42 are provided as light emitting components. However, the scope of the present invention is not limited to such a configuration. For example, laser diodes or light emitting components, currents of which are adjustable, may be provided.

The technical elements described in this specification and the drawings may be used independently or in combination to achieve the technical benefits. The combinations and the category are not limited to those in original claims. For example, the following methods may provide the technical benefits.

A method illustrated in this specification and the drawings is to drive a lighting device having the following configuration. The lighting device includes light emitting units, drivers, a current divider, and a power supply unit. Each light emitting unit includes a plurality of light emitting components connected in series. The drivers are configured to control driving of the light emitting units and connected in series with the light emitting components. The current divider is connected in parallel to the drivers in the series circuits including the light emitting units and the drivers. The power supply unit is configured to apply a voltage to the series circuits. The series circuits to which the current divider is connected are connected in parallel to each other. The power supply unit applies the same voltage to the series circuits. Currents that flow through the light emitting units in the series circuits are adjusted to a common constant amount. The method includes adjusting the first divided current Id1 in the first current divider connected to the first series circuit is larger than the second divided current Id2 in the second current divider connected to the second series circuit to satisfy the following condition. The first forward voltage Vf1 of the first light emitting unit of the first series circuit is lower than second forward voltage Vf2 of the second light emitting unit of the second series circuit.

According to the method of driving the light emitting device illustrated in this specification and the drawings, a relatively small current flows in the driver of the series circuit to which a relatively high excessive voltage is applied to the driver. Therefore, the power loss in the driver can be reduced and effects for reducing the temperature increase in the driver can be achieved.

With the technologies described in this specification and the drawings, multiple objects may be accomplished at the same time. However, the technical benefits can be achieved by accomplishing even only one of the objects.

EXPLANATION OF SYMBOLS

10: LED backlight, 20: Circuit, 22: Power supply unit, 24: Control unit, 30: Light emitting unit, 32: Driver, 34: Current divider, 36: Current divider driver, 40: Regenerator, 42: LED, H: Parallel circuit, T: Series circuit, Vf: Forward voltage, Vk: Driver voltage, Ik: Driver current, Id: Divided current

The invention claimed is:

1. A light emitting device, comprising:

a light emitting unit including a plurality of light emitting components connected in series;

a driver configured to control the light emitting unit and connected in series with the light emitting components so as to form a series circuit;

a current divider connected in parallel to the driver of the series circuit;

a power supply unit configured to apply a voltage to the series circuit; and a control unit;

wherein the light emitting unit includes at least a first light emitting unit and a second light emitting unit, the driver includes at least a first driver and a second driver, the first driver is configured to control the first light emitting unit, and the second driver is configured to control the second light emitting unit, the series circuit includes at least a first series circuit and a second series circuit connected in parallel to each other, and the first series circuit includes the first light emitting unit, the current divider includes at least a first current divider and a second current divider connected to the first series circuit and the second series circuit, respectively, the power supply unit is configured to apply the same voltage to the series circuit, and the control unit is configure to determine whether a first forward voltage of the first light emitting unit is lower than a second forward voltage of the second light emitting unit, and control the first and the second drivers and the first and the second current dividers such that a first divided current in the first current divider is larger than a second divided current in the second current divider to adjust currents that flow through the light emitting units to a common constant amount if the first forward voltage is lower than the second forward voltage.

2. The light emitting device according to claim 1, further comprising a regenerator connected to at least one of the current dividers and configured to receive the divided current from the at least one of the current dividers, to generate a power from the received divided current, and to store the power.

3. The light emitting device according to claim 1, wherein the first and the second current dividers include current divider drivers, respectively, each current divider driver being configured to control the first and the second current dividers to adjust the divided currents in the first current divider and the second current divider.

4. The light emitting device according to claim 3, wherein the control unit is configured to control the driver and the current divider driver.

5. The light emitting device according to claim 4, wherein the control unit is configured to measure a driver voltage applied to the driver of each series circuit, a driver current in each driver, and the divided current in each current driver connected to the corresponding series circuit, and to control the drivers and the current divider drivers based on the measurements.

6. The light emitting device according to claim 4, wherein the control unit is configured to determine which one of at least the first series circuit and the second series circuit includes the light emitting unit, the forward voltage of which is a maximum voltage, and control the current divider driver to restrict a flow of the divided current in the current divider connected to the series circuit including the light emitting unit, the forward voltage of which is the maximum voltage.

7. The light emitting device according to claim 1, wherein the light emitting components are LEDs.

8. A backlight for a liquid crystal display device, the backlight comprising a light emitting device, the light emitting device comprising:

a light emitting unit including a plurality of light emitting components connected in series:

a driver configured to control the light emitting unit and connected in series with the light emitting components so as to form a series circuit;

a current divider connected in parallel to the driver of the series circuit;

a power supply unit configured to apply a voltage to the series circuit; and a control unit;

wherein the light emitting unit includes at least a first light emitting unit and a second light emitting unit, the driver includes at least a first driver and a second driver, the first driver is configured to control the first light emitting unit, and the second driver is configured to control the second light emitting unit, the series circuit includes at least a first series circuit and a second series circuit connected in parallel to each other, and the first series circuit includes the first light emitting unit, the current divider includes at least a first current divider and a second current divider connected to the first series circuit and the second series circuit, respectively, the power supply unit is configured to apply the same voltage to the series circuit, and the control unit is configure to determine whether a first forward voltage of the first light emitting unit is lower than a second forward voltage of the second light emitting unit, and control the first and the second drivers and the first and the second current dividers such that a first divided current in the first current divider is larger than a second divided current in the second current divider to adjust currents that flow through the light emitting units to a common constant amount if the first forward voltage is lower than the second forward voltage.

9. A method of controlling a light emitting device including at least a first series circuit, a second series circuit, a first current divider, and a second current divider, the first series circuit including a first light emitting unit and a first driver connected in series with each other, the second series circuit including a second light emitting unit and a second driver connected in series with each other, the first and the second series circuit being connected in parallel to each other, the first current divider being connected to the first series circuit, the second current divider being connected to the second series circuit, the method comprising:

applying a same voltage to at least the first series circuit and the second series circuit;

adjusting currents in at least the first series circuit and the second series circuit to a common constant amount;

determining whether a first forward voltage of the first light emitting unit is lower than a second forward voltage of the second light emitting unit; and adjusting at least one of a first divided current in the first current divider and a second divided current in the second current divider such that the first divided current is larger than the second divided current if the first forward voltage is lower than the second forward voltage.

10. The method according to claim 9, further comprising regenerating a power from at least one of the divided currents.

11. The method according to claim 9, further comprising:

measuring driver voltages applied to at least the first driver and the second driver;

measuring driver currents in at least the first driver and the second driver;

measuring at least the first divided current and the second divided current; and adjusting the currents in at least the first series circuit and the second series circuit, and at least one of the first divided current and the second divided current based on the measurements of the driver voltages, the driver currents, and at least the first divided current and the second divided current.

12. The method according to claim 9, further comprising:

determining which one of at least the first series circuit and the second series circuit includes the light emitting unit, the forward voltage of which is a maximum voltage; and restricting a flow of the divided current in the current divider connected to the series circuit including the light emitting unit, the forward voltage of which is the maximum voltage.

* * * * *